US005191168A

United States Patent [19]

Puckett

[11] Patent Number: 5,191,168

[45] Date of Patent: Mar. 2, 1993

[54] SABOT FOR HIGH DISPERSION SHOT SHELL

[75] Inventor: Lawrence J. Puckett, Churchville, Md.

[73] Assignee: The United States of America as represented by the Secretary of the Army, Washington, D.C.

[21] Appl. No.: 828,321

[22] Filed: Jan. 29, 1992

[51] Int. Cl.[5] ..... F42B 7/02

[52] U.S. Cl. ..... 102/457; 102/520; 102/532

[58] Field of Search ..... 102/443, 448–461, 102/439, 489, 520–523, 532

[56] References Cited

U.S. PATENT DOCUMENTS

| | | | |
|---|---|---|---|
| 579,429 | 8/1897 | Elliott . | |
| 820,459 | 4/1906 | White . | |
| 875,762 | 12/1908 | Winans et al. . | |
| 1,941,336 | 9/1933 | Barbieri . | |
| 3,261,282 | 7/1966 | Hendricks | 102/453 |
| 4,006,688 | 1/1977 | Craft et al. . | |
| 4,167,904 | 9/1979 | Ferri | 102/457 |
| 4,800,816 | 1/1989 | Meyer | 102/523 |
| 4,882,996 | 3/1989 | Bock et al. . | |

FOREIGN PATENT DOCUMENTS

| | | | |
|---|---|---|---|
| 92430 | 11/1968 | France | 102/532 |

*Primary Examiner*—Harold J. Tudor

*Attorney, Agent, or Firm*—Saul Elbaum; Jason M. Shapiro

[57] ABSTRACT

A sabot for a shotgun shell provided with a recess in its base upon which propellant gases may act to radially expand and flatten the sabot thereby enhancing the dispersion of shot. In alternate embodiments the recess may be conoidal, parabolic, pyramidal, or an involute surface resembling a cone. The recess may also be comprised of multiple overlapping layers. Each recess provides a unique shot pattern for short-range antipersonnel engagements. In other embodiments, the foregoing recesses are provided with grooves to facilitate petalling of the recess and flattening of the sabot during and after launch. In another embodiment, the recess is filled with propellant and capped with a consumable plug to delay ignition of the propellant charge, further enhancing shot dispersion.

13 Claims, 5 Drawing Sheets

11

11

25

SABOT FOR HIGH DISPERSION SHOT SHELL

GOVERNMENTAL INTEREST

The invention described herein may be manufactured, used and licensed by or for the U.S. Government for governmental purposes without the payment to me of any royalties thereon.

BACKGROUND OF THE INVENTION

The present invention relates to ammunition for shotguns, and more particularly to a sabot for a shot-gun shell capable of enhancing shot dispersion.

Conventional shot-gun shells are designed to control shot patterns at ranges of engagement typical of sporting applications. Such engagements vary from a short range of approximately 20 meters, typical of upland game shooting, to extreme ranges of 40–50 meters, typical of water fowling.

Law enforcement agencies have endeavored to exploit the advantages of large shot patterns available from such weapons to improve the effectiveness of law enforcement personnel engaged in close range antipersonnel actions. Current technology, however, has not produced a shot shell and weapon capable of providing a high dispersion of shot at the short ranges typical of building clearing operations, for example. Shooting engagement ranges for such operations are usually on the order of 5 to 15 meters, where shot dispersion pattern diameters range from approximately 5 to 20 centimeters. These small diameter patterns do not materially enhance the probability of hitting the personnel target. In fact single projectile, burst fire and semi-automatic weapons are becoming more popular due primarily to the large dispersion pattern of shots.

SUMMARY OF THE INVENTION

Accordingly, it is an object of the present invention to provide a shot shell design which when used in a conventional shot gun will achieve an enhanced pellet dispersion pattern in short-range antipersonnel engagements.

It is a further object of the present invention to provide a sabot for use in a standard shot shell which enhances pellet dispersion for short-range antipersonnel engagements.

It is another object of the present invention to provide a sabot which deforms after launch as a consequence of existing propellant gases and in such a manner as to release a broad pattern of shot at short range.

It is yet another object of the present invention to provide a sabot which is launched in a conventional manner and as a consequence of an additional charge is made to deform after launch in such a manner as to release an even broader pattern of shot at short range.

It is still another object of the present invention to provide an economical device for enhancing the dispersion of shot without the use of mechanical chokes or similar mechanisms.

These objects and others not specifically enumerated are accomplished with a sabot provided with a recess in its base upon which propellant gases may act to radially expand and flatten the sabot thereby enhancing the dispersion of shot.

In alternate embodiments the recess may be conoidal, parabolic, pyramidal, or an involute surface resembling a cone. The recess may also be comprised of multiple overlapping layers. Each recess provides a unique shot pattern for short-range antipersonnel engagements.

In other embodiments, the foregoing recesses are provided with grooves to facilitate petalling of the recess and radial expansion or flattening of the sabot during and after launch.

In another embodiment, the recess is filled with propellant and capped with a consumable plug to delay ignition and to increase deformation of the sabot, further enhancing shot dispersion.

BRIEF DESCRIPTION OF THE DRAWINGS

The preferred embodiments of the present invention will be described with reference to the accompanying drawings.

DESCRIPTION OF THE PREFERRED EMBODIMENTS

Figure 1:
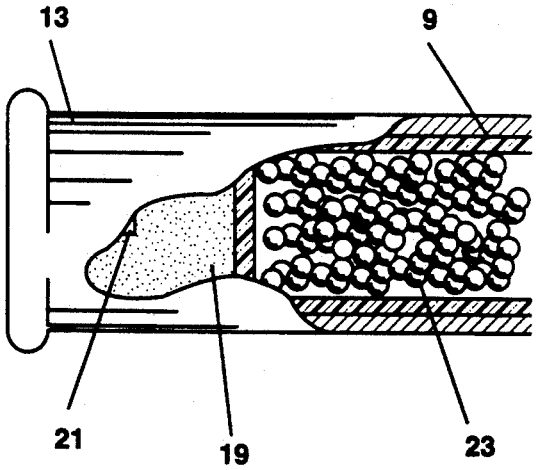
PRIOR ART FIG. 1
FIG. 1 is a cross-sectional view of a prior art shotgun shell.

Unlike conventional shot-gun shell designs (See FIG. 1) Which use a sabot 9 to minimize shot deformation during the firing cycle and to delay aerodynamically-induced pellet dispersion, the present invention exploits the propellant gas pressure to enhance dispersion of the pellet column 23.

Figure 2:
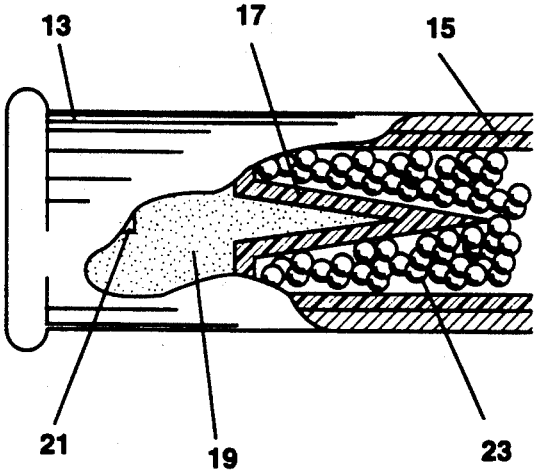
FIG. 2 is a cross-sectional view of the first embodiment of the present invention, depicting the sabot with a centrally located recess.

In a first embodiment, shown in FIG. 2, the sabot 15 is provided with a recess 17 which is centrally located in the base of the sabot 15. Base and recess 17 have a substantially uniform thickness. Apart from the recess 17, the sabot is conventional and can be made to fit any gauge of casing 13. Disposed within the casing 13 and immediately behind the sabot 15 is a propellant 19. Which is typical of conventional shot gun shells such as that illustrated in FIG. 1. Protruding from the base of the casing 13 and into the propellant 19 is a standard ignitor 21.

The sabot 15 is typically comprised of a plastic, such as nylon or polyethylene, which is able to withstand the extreme temperatures and pressures of combustion without fracturing or exhibiting significant flow. The side walls of the sabot 15 are generally cylindrical, and may be grooved to facilitate petalling during flight. As with a conventional shot shell, a plurality of pellets, or shot 23, is held within the sabot 15, although the presence of the recess 17 reduces the total quantity of shot 23 carried. The shot 23 may be lead or some other heavy metal, or it may be comprised of rubber pellets for riot control. No additional spreading device is placed amid the column of shot 23.

In operation, the hammer of the gun impacts with the ignitor 21 and sets up a combustion wave which ultimately ignites the propellant 19. The propellant gases expand against the base of the sabot 15 and into the recess 17, causing the sabot 15 and its load of shot 23 to travel down the bore of the gun (not illustrated). When the sabot 15 exits the confines of the gun barrel, the gas pressure Causes the recess 17 to open and imparts a transverse velocity component to the shot 23. Similarly, aerodynamic forces compel the cylindrical side walls of the sabot 15 to flare, allowing the catapulted shot 23 to disperse. The cumulative effect is somewhat like the opening of an umbrella, with the sabot 15 flattening and the shot 23 spreading in a broad pattern.

Figure 3:
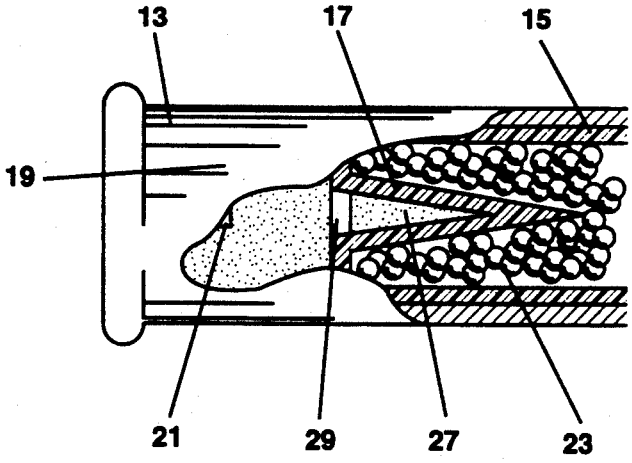
FIG. 3 is a cross-sectional view of a second embodiment of the present invention, depicting a propellant-filled recess, and a consumable plug.

FIG. 3 illustrates an alternate and preferred embodiment of the present invention where the centrally located recess 17 is filled with a solid propellant 27 and capped with a consumable plug 29. This arrangement delays the combustion of the cavity (recess) propellant 27 to produce the maximum pellet dispersion pressure in the vicinity of emergence from the gun barrel, thereby maximizing shot dispersion. The solid propellant 27 within the cavity 17 is the same as or similar to the propellant 19 used in the casing 13. The plug 29 may be fabricated from paper or a wax compound and press-fit into the recess 17 atop the solid propellant 27. The rate of burn and thickness of the plug 29 determines when the solid propellant 27 within the cavity 17 will ignite. Thus, it is possible to achieve extremely high dispersal pressures after launch, at a point in time when normal gun barrel pressures are somewhat lessened by expansion within the barrel and out the muzzle.

It is preferred that the recess 17 have a depth approximately equal to the height of the column of shot 23 in order to impart some transverse component of velocity to a greater portion of the shot 23. In addition, the diameter of the recess 17 should be between five and twenty percent that of the shell 13 depending on the range of engagement expected. This ensures proper shot dispersion and pellet concentration at short ranges (e.g. an approximately one meter diameter spread at ten meters).

Thus, for a very short range of engagement, a shell provided with a larger recess (e.g. 20% shell diameter) is prefered, as dispersion must be complete at or near the point of impact. At longer ranges of engagement it is preferable to induce less shot divergence, since there is time for the proper spread to be achieved. Put another way, a larger recess and charge will induce a larger angular divergence per unit time. Since at short distances there is not much time for the shot column to spread, a larger recess is required to achieve a broader pattern. Limiting the size of the recess to less than 20% of the shell diameter ensures that a sufficient quantity and concentration of shot will arrive at the target. Conversely, recess sizes smaller than about 5% of the shell diameter are not likely to induce sufficient angular divergence at the ranges of engagement contemplated.

Figure 4:
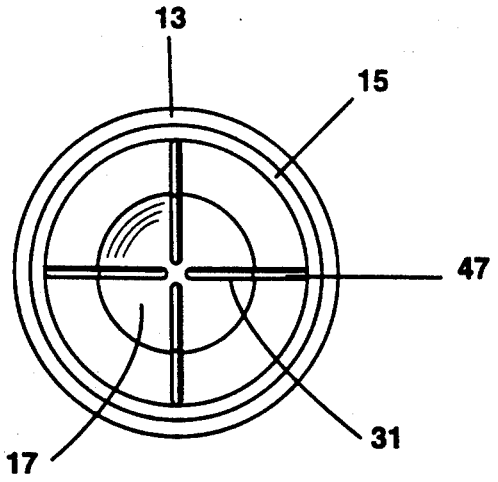
FIG. 4 is a plan-view of the front of a shotgun shell (uncrimped) according to the present invention and further provided with a grooved recess.
Figure 6:
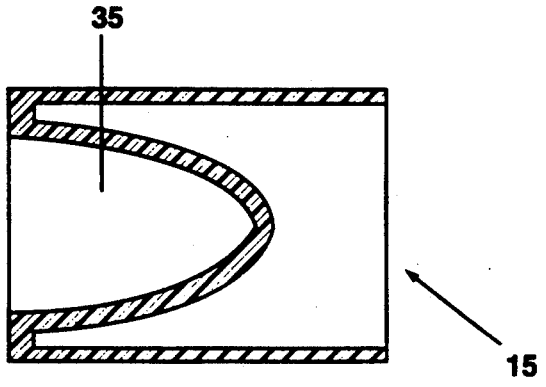
FIG. 6 is a cross-sectional view of a parabolic recess profile.
Figure 5:
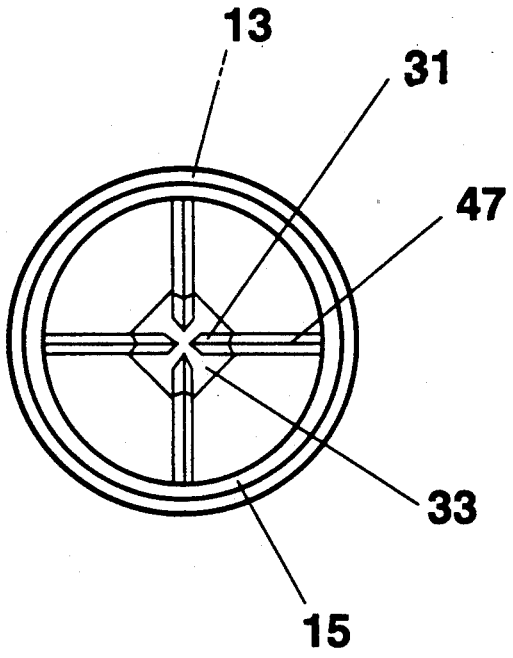
FIG. 5 is a plan-view of the front of a shotgun shell (uncrimped) according to the present invention and further provided with a pyramidal recess.

The profile of the recess 17 in either of the foregoing embodiments is critical to the shape and breadth of the shot pattern produced. A conoidal surface as illustrated in FIGS. 2, 3, and 4, provides optimum surface area, depth, and mechanical advantage, thereby imparting great transverse velocity components to the entire shot column 23. Other possible profiles include a pyramidal recess 33 (FIG. 5) which offers similar benefits, a parabolic recess 35 (FIG. 6), and an involute surface such as the conoid 37 depicted in FIG. 7. Regardless of profile, it is desirable to provide lines of weakening, or grooves 31, which are oriented longitudinally on the recess 17 in order to reduce the overall stiffness of the sabot 15. In a preferred embodiment, lines of weakening or grooves 47 are also arranged radially upon the base of the sabot, and made to align with the grooves 31 on any of the recesses 17, 33, 35, 37, or 41. This, in turn, hastens the deformation of the recess 17 and increases the magnitude of the transverse velocity components imparted to the column of shot 23.

Figure 7:
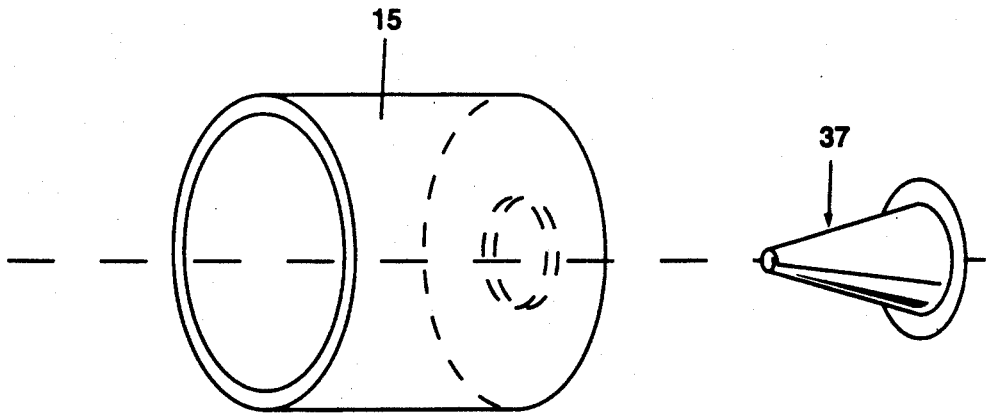
FIG. 7 is a break-away view of a sabot according to the present invention provided with a recess which is an involute surface resembling a cone.
Figure 8:
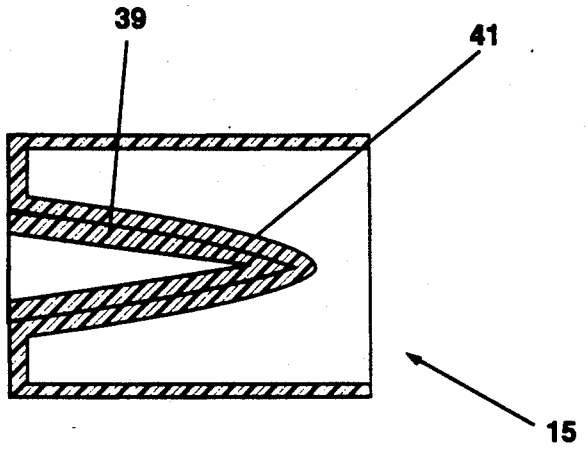
FIG. 8 is a cross-sectional view of a multi-layer recess according to the present invention.
Figure 9:
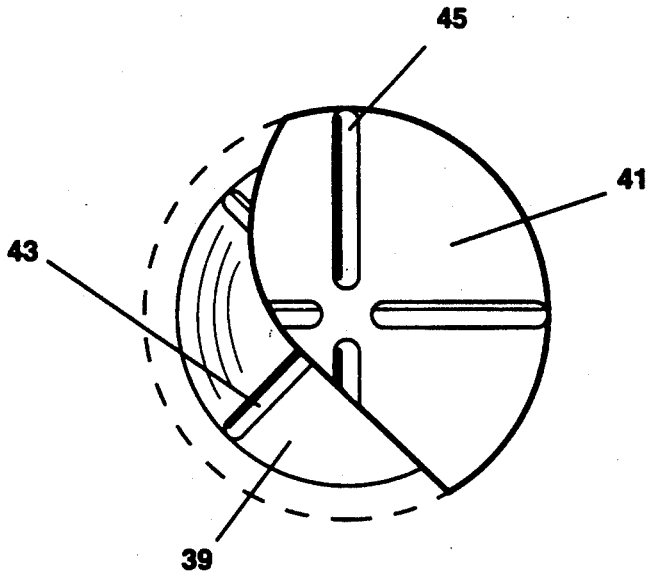
FIG. 9 is a cut-away of a multi-layer recess having offset grooves.
Figure 10:
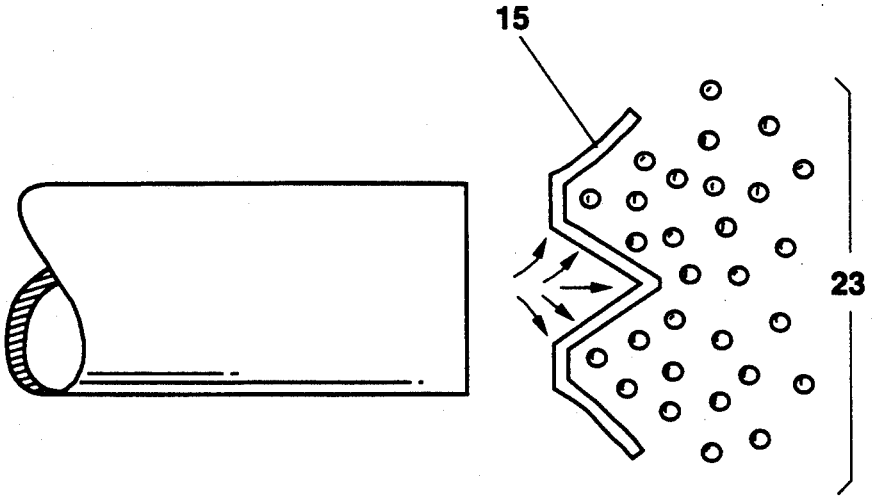
FIG. 10 illustrates the process by which a sabot according to the present invention spreads a load of shot.

The involute conoid of FIG. 7 will also impart a limited radial velocity or spin to the shot 23 as it unfurls under the propellant gas pressure. Where the surface of the cone 37 is rough or provided with ribs, this radial component will be magnified. For purposes of manufacture, it is desirable to fabricate the sabot 15 with a hole in its base and a separate involute conoid 37. The two parts may be chemically bonded or fused together using conventional techniques. The tip of the cone may also be bonded or fused to provide a more definite fulcrum.

Where any of the foregoing recesses 17 have been weakened by grooves 31 it may be that some of the propellant gases will escape. Therefore, in another embodiment shown in FIGS. 8 and 9, the recess 17 is comprised of multiple, overlapping walls 39 and 41, and the lines of weakening, or grooves 43 and 45 are offset from one another, so that when the inner set of grooves 43 fails the gas is contained for a time within the other wall 41.

While there has been described and illustrated specific embodiments of the invention, it will be obvious that various changes, modifications and additions can be made herein without departing from the field of the invention which should be limited only by the scope of the appended claims.

I claim:

1. A sabot for a shotgun shell, said sabot comprising a tubular portion and a base, wherein said tubular portion attaches to said base forming a cup-like member for launching a load of shot, said base being provided with a centrally disposed recess which protrudes into said load of shot said base, including said recess, having a substantially uniform thickness, whereby a distance approximately equal to the length of said tubular portion, said recess expands readily under the influence of propellant gases and imparts to a substantial portion of said shot a transverse velocity component, thereby enhancing shot dispersion.

2. The invention of claim 1 wherein said recess is defined by a conoidal surface.

3. The invention of claim 1 wherein said recess is defined by a paraboloid surface.

4. The invention of claim 1 wherein said recess is defined by a pyramidal surface.

5. The invention of claim 1, 2, 3 or 4 wherein said base and centrally located recess are provided with a plurality of radial grooves, the presence of which facilitates petalling and outward expansion of said recess.

6. The invention of claim 1, 2, 3 or 4 wherein said recess contains solid propellant.

7. The invention of claim 6 further comprising a consumable plug disposed within said recess to delay ignition of said propellant.

8. The invention of claim 5 wherein said recess contains solid propellant.

9. The invention of claim 8 further comprising a consumable plug disposed within said recess to delay ignition of said propellant.

10. A sabot for a shotgun shell, said sabot comprising a base and side walls, wherein said walls attach to said base to contain a load of shot, and said base is provided with a centrally located conoidal recess, said recess being filled with solid propellant and stopped with a consumable plug, said base and centrally located recess being provided with a plurality of radial grooves, the presence of which facilitates petalling and expansion of said recess, resulting in enhanced dispersion of said shot.

11. The invention of claim 10 wherein said recess has a depth approximately equal to the height of said walls.

12. The invention of claim 1 or 10 wherein the base diameter of said recess is 5 to 20 percent that of the shell.

13. The invention of claim 11 wherein the base diameter of said recess is 5 to 20 percent that of the shell.

* * * * *

UNITED STATES PATENT AND TRADEMARK OFFICE

CERTIFICATE OF CORRECTION

PATENT NO. : 5,191,168

DATED : March 2, 1993

INVENTOR(S) : Lawrence J. Puckett

It is certified that error appears in the above-identified patent and that said Letters Patent is hereby corrected as shown below:

column 2, line 45, substitute --which-- for "Which"; at line 56, delete "."; and at line 57, substitute --which-- for "Which". In column 3, at line 13, substitute --causes-- for "Causes"

In Claim 1, at line 6, insert --adistance approximately equal to the length of said tubular portion, --after "shot"; and at lines 7-9 delete "a distance approximately equal to the length of said tubular portion,".

Signed and Sealed this

Twenty-eighth Day of December, 1993

*Attest:*

Bruce Lehman

BRUCE LEHMAN

*Attesting Officer*

*Commissioner of Patents and Trademarks*